US010125542B1

(12) United States Patent
Wandschneider

(10) Patent No.: US 10,125,542 B1
(45) Date of Patent: Nov. 13, 2018

(54) MAGNETIC ORGANIZING DEVICE

(71) Applicant: Todd Wandschneider, Afton, MN (US)

(72) Inventor: Todd Wandschneider, Afton, MN (US)

( * ) Notice: Subject to any disclaimer, the term of this patent is extended or adjusted under 35 U.S.C. 154(b) by 0 days.

(21) Appl. No.: 15/590,507

(22) Filed: May 9, 2017

(51) Int. Cl.

| | |
|---|---|
| ***E06C 7/14*** | (2006.01) |
| *E06C 7/00* | (2006.01) |
| *E06C 1/00* | (2006.01) |
| *B25H 3/00* | (2006.01) |
| *B44D 3/14* | (2006.01) |

(52) U.S. Cl.
CPC ..... *E06C 7/14* (2013.01); *B25H 3/00* (2013.01); *B44D 3/14* (2013.01); *E06C 1/00* (2013.01); *E06C 7/00* (2013.01)

(58) Field of Classification Search
CPC ..... G09F 7/04; E06C 7/14; E06C 7/18; E06C 1/39; E06C 1/393; B25H 3/06
See application file for complete search history.

(56) References Cited

U.S. PATENT DOCUMENTS

| | | | | |
|---|---|---|---|---|
| 5,098,052 | A * | 3/1992 | Beck | E06C 7/14 182/126 |
| 6,587,022 | B1 | 7/2003 | Devine | |
| 6,811,127 | B1 | 11/2004 | Shiao | |
| 7,032,711 | B1 * | 4/2006 | Katz | B25H 3/06 182/129 |
| 7,114,592 | B1 * | 10/2006 | Gibson | E06C 1/39 182/129 |
| D541,433 | S | 4/2007 | Wise | |
| D678,550 | S * | 3/2013 | Carlson | D25/68 |
| 8,596,454 | B1 * | 12/2013 | Carlson | E06C 7/14 182/129 |
| 8,925,685 | B2 * | 1/2015 | Dufour | E06C 7/14 182/129 |
| 9,359,819 | B1 * | 6/2016 | Valadez | E06C 7/14 |
| 2005/0173189 | A1 * | 8/2005 | Berardi | E06C 7/003 182/18 |
| 2006/0006024 | A1 * | 1/2006 | Till | E06C 1/39 182/129 |
| 2009/0095568 | A1 * | 4/2009 | Webster | E06C 7/14 182/129 |
| 2009/0283361 | A1 * | 11/2009 | Gibson | E06C 7/14 182/129 |
| 2010/0200331 | A1 * | 8/2010 | Hager | E06C 1/06 182/107 |
| 2013/0112502 | A1 * | 5/2013 | Oliver | E06C 7/14 182/129 |

FOREIGN PATENT DOCUMENTS

| | | |
|---|---|---|
| WO | WO03081613 | 10/2003 |

* cited by examiner

*Primary Examiner* — Daniel P Cahn

(57) ABSTRACT

A magnetic organizing device for a ladder includes a ladder and a container. The container is coupled to the ladder proximate to an upper end of the ladder. The container is open-topped and magnetized. The container is configured to retain items that are positioned in the container. The container also is configured to retain ferromagnetic articles, such as screws and nails, within the container as the ladder is reoriented from a substantially vertical configuration to a substantially horizontal configuration.

9 Claims, 3 Drawing Sheets

MAGNETIC ORGANIZING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to organizing devices and more particularly pertains to a new organizing device for a ladder.

BRIEF SUMMARY OF THE INVENTION

An embodiment of the disclosure meets the needs presented above by generally comprising a ladder and a container. The container is coupled to the ladder proximate to an upper end of the ladder. The container is open-topped and magnetized. The container is configured to retain items that are positioned in the container. The container also is configured to retain ferromagnetic articles, such as screws and nails, within the container as the ladder is reoriented from a substantially vertical configuration to a substantially horizontal configuration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
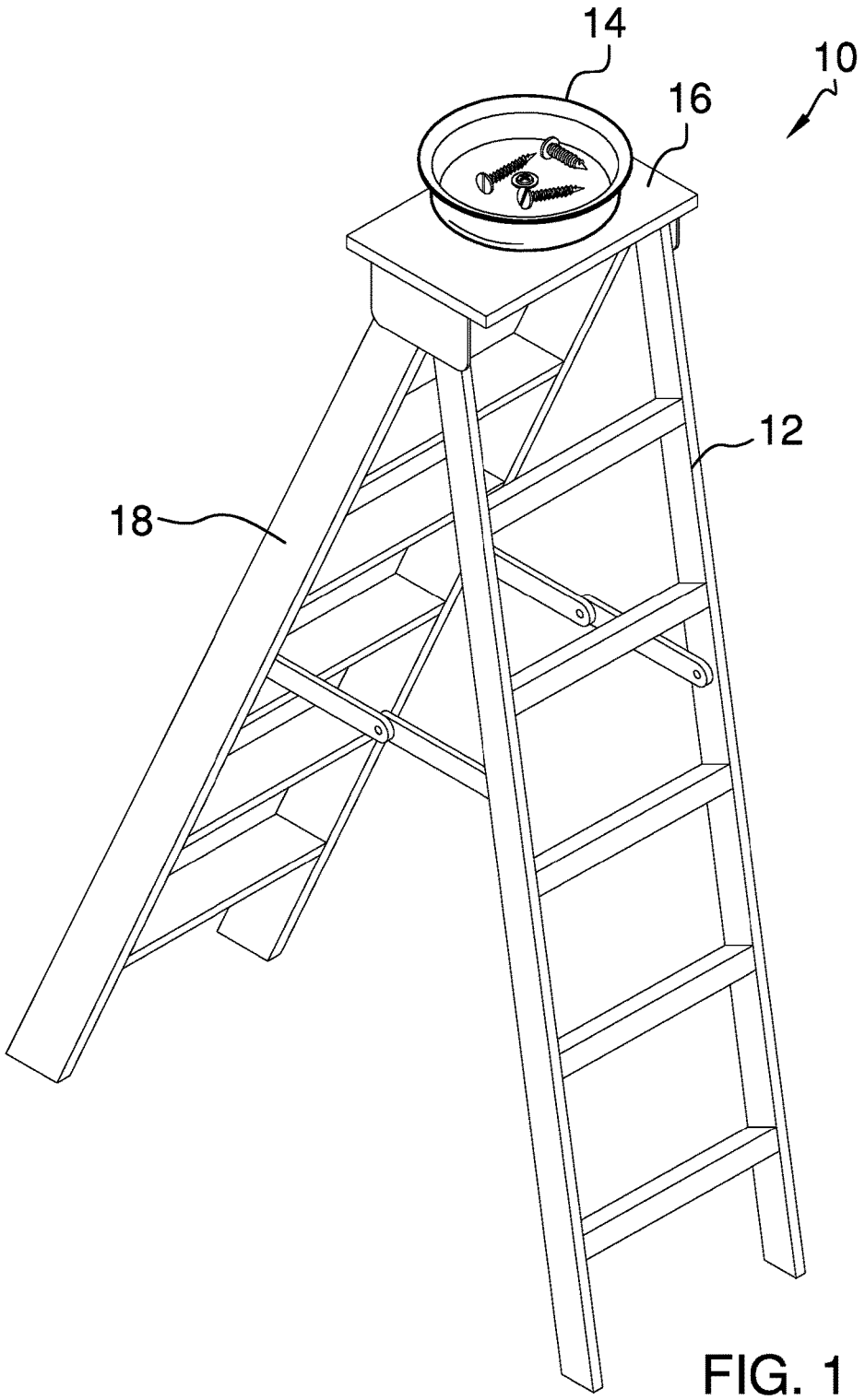
FIG. 1 is an isometric perspective view of a magnetic organizing device according to an embodiment of the disclosure.
Figure 2:
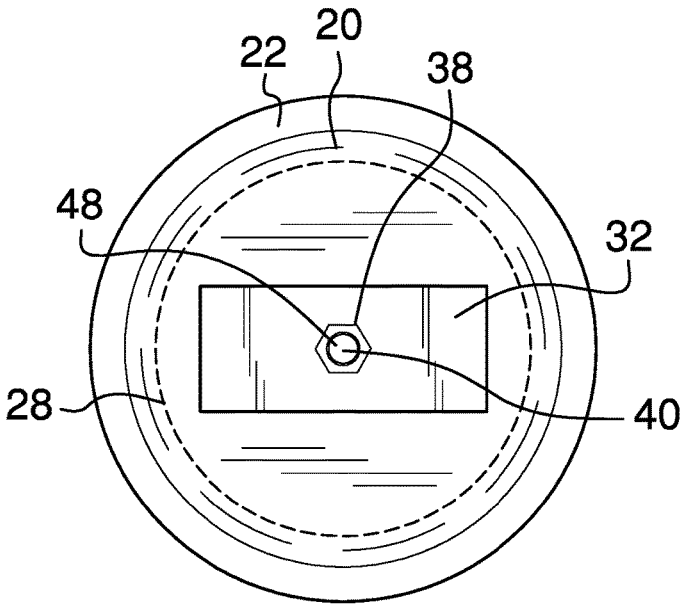
FIG. 2 is a bottom view of an embodiment of the disclosure.
Figure 3:
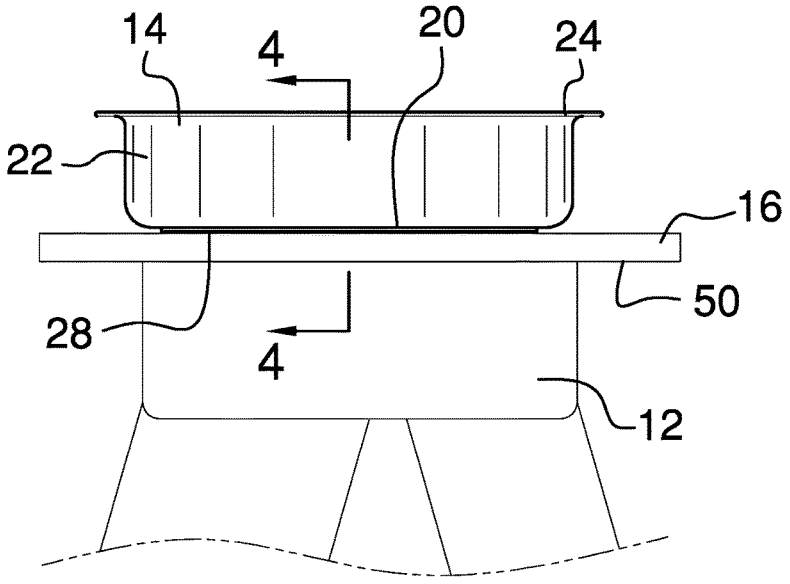
FIG. 3 is a side view of an embodiment of the disclosure.
Figure 4:
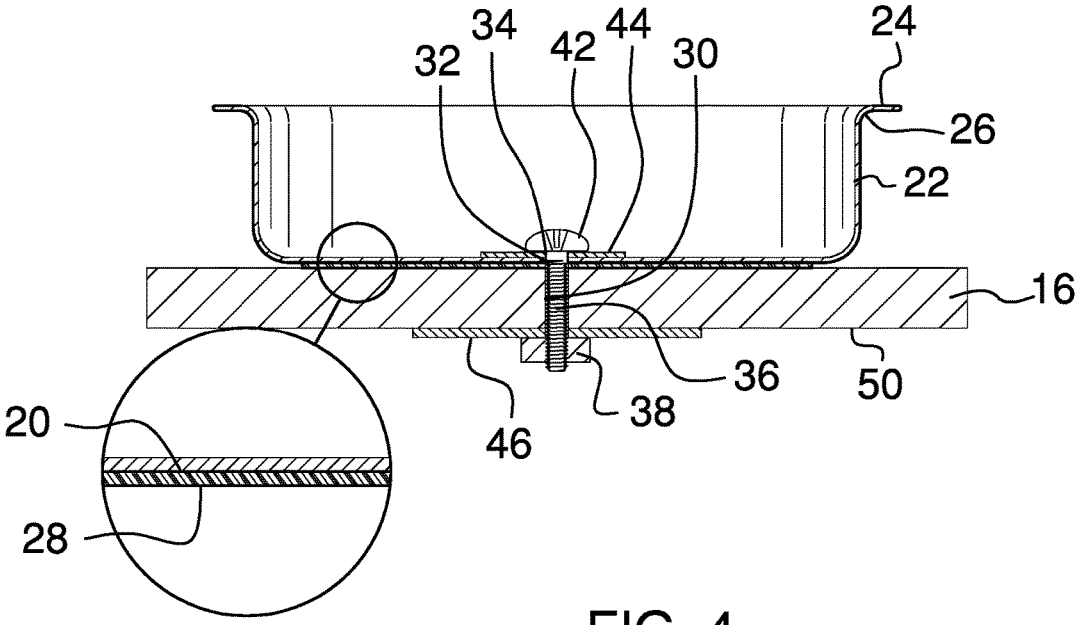
FIG. 4 is a cross-sectional view of an embodiment of the disclosure.
Figure 5:
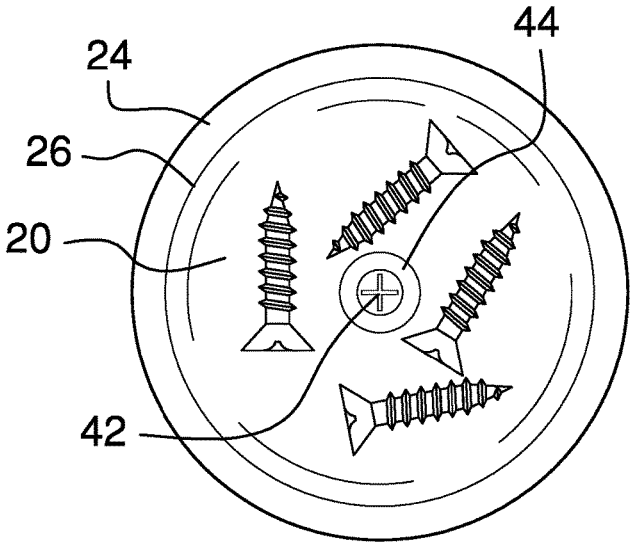
FIG. 5 is a top view of an embodiment of the disclosure.

With reference now to the drawings, and in particular to FIGS. 1 through 5 thereof, a new organizing device embodying the principles and concepts of an embodiment of the disclosure and generally designated by the reference numeral 10 will be described.

As best illustrated in FIGS. 1 through 5, the magnetic organizing device 10 generally comprises a ladder 12 and a container 14. The container 14 is coupled to the ladder 12 proximate to an upper end 16 of the ladder 12. The container 14 is open-topped and magnetized. The container 14 is configured to retain items that are positioned in the container 14. The container 14 also is configured to retain ferromagnetic articles, such as screws and nails, within the container 14 as the ladder 12 is reoriented from a substantially vertical configuration to a substantially horizontal configuration. In one embodiment, the ladder 12 is a step ladder 18. In another embodiment, the container 14 comprises metal. In yet another embodiment, the container 14 is coupled to the upper end 16 of the ladder 12.

In one embodiment, the container 14 comprises a first plate 20 and an annular wall 22. The annular wall 22 is coupled to and extends from the first plate 20. In another embodiment, the first plate 20 is circularly shaped. In yet another embodiment, a rim 24 is coupled to and extends transversely from a circumference 26 of the annular wall 22.

A magnet 28 is positioned between and is coupled to the ladder 12 and the container 14. The magnet 28 is configured to generate a magnetic field within the container 14. The ferromagnetic articles that are positioned within the container 14 are magnetically coupled to the magnet 28. In one embodiment, the magnet 28 is substantially complementary to the first plate 20.

A first hole 30 is positioned in the ladder 12. A second hole 32 is positioned in the magnet. The second hole 32 is alignable with the first hole 30. A third hole 34 is positioned through the first plate 20. The third hole 34 is complementary to and alignable with the second hole 32. The device 10 comprises a bolt 36 and a nut 38, which is complementary to the bolt 36. The bolt 36 is substantially complementary to the second hole 32 and the third hole 34. The first hole 30, the second hole 32 and the third hole 34 are positioned to insert a threaded end 40 of the bolt 36 sequentially through the third hole 34, the second hole 32 and the first hole 30. A head 42 of the bolt 36 abuts the first plate 20. The nut 38 is positioned to threadedly couple to the bolt 36 to couple the container 14 and the magnet 28 to the ladder 12. In one embodiment, the first hole 30 is substantially centrally positioned in the upper end 16 of the ladder 12, the second hole 32 is substantially centrally positioned in the magnet, and the third hole 34 is substantially centrally positioned in the first plate 20.

In one embodiment, a washer 44 is positioned between the first plate 20 and the head 42 of the bolt 36. In another embodiment, the device 10 comprises a second plate 46. A fourth hole 48 is positioned through the second plate 46. The fourth hole 48 is complementary to the bolt 36. The fourth hole 48 is positioned in the second plate 46 so that the second plate 46 is positionable between the nut 38 and the ladder 12. The second plate 46 abuts a lower surface 50 of the upper end 16 of the ladder 12. In yet another embodiment, the second plate 46 is substantially rectangularly shaped.

In use, the container 14 is configured to retain items that are positioned in the container 14. The magnet 28 is configured to generate the magnetic field within the container 14 to retain the ferromagnetic articles, such as the screws and the nails, within the container 14 as the ladder 12 is reoriented from the substantially vertical configuration to the substantially horizontal configuration.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic organizing device comprising:

a ladder;

a container coupled to said ladder proximate to an upper end of said ladder, said container being open-topped, said container being magnetized, said container comprising a first plate and an annular wall, said annular wall being coupled to and extending from said first plate to define an outermost edge of said container, said container including a rim coupled to and extending outwardly from an outer circumference of said annular wall, said rim being planar and defining a free outermost edge of said container;

a magnet positioned between and coupled to said ladder and said container;

a first hole being substantially centrally positioned in said upper end of said ladder;

a second hole positioned in said magnet, said second hole being alignable with said first hole;

a third hole positioned through said first plate, said third hole being complementary to and alignable with said second hole;

a bolt substantially complementary to said first, second and third holes, wherein said first hole, said second hole and said third hole are positioned for inserting a threaded end of said bolt sequentially through said third hole, said second hole and said first hole, such that a head of said bolt abuts said first plate;

a nut complementary to said bolt, wherein said nut is configured to threadedly couple to said bolt to couple said container and said magnet to said ladder; and, wherein said container is positioned on said ladder such that said container is configured to retain items positioned in said container, wherein said container is configured to retain ferromagnetic articles within said container as said ladder is reoriented from a substantially vertical configuration to a substantially horizontal configuration, and wherein said magnet generates a magnetic field within said container such that the ferromagnetic articles positioned within said container are magnetically coupled to said magnet.

2. The device of claim 1, further including said ladder being a step ladder.

3. The device of claim 1, further including said container comprising metal.

4. The device of claim 1, further including said container being coupled to said upper end of said ladder.

5. The device of claim 1, further including said first plate being circularly shaped.

6. The device of claim 1, further including said magnet being substantially complementary to said first plate.

7. The device of claim 1, further including a washer positioned between said first plate and said head of said bolt.

8. The device of claim 1, further comprising:

a second plate, said second plate being substantially rectangularly shaped;

a fourth hole positioned through said second plate, said fourth hole being complementary to said bolt; and wherein said fourth hole is positioned in said second plate such that said second plate is positionable between said nut and said ladder, such that said second plate abuts a lower surface of said upper end of said ladder.

9. A magnetic organizing device comprising:

a ladder, said ladder being a step ladder;

a container coupled to said ladder proximate to an upper end of said ladder, said container being open-topped, said container being magnetized, wherein said container is positioned on said ladder such that said container is configured for retaining items positioned in said container and wherein said container is configured for retaining ferromagnetic articles within said container as said ladder is reoriented from a substantially vertical configuration to a substantially horizontal configuration, said container comprising metal, said container being coupled to said upper end of said ladder, said container comprising:

a first plate, said first plate being circularly shaped, an annular wall coupled to and extending from said first plate, and a rim coupled to and extending outwardly from an outer circumference of said annular wall, said rim being planar defining a free outermost edge of said container;

a magnet positioned between and coupled to said ladder and said container, wherein said magnet is positioned on said ladder such that said magnet is configured for generating a magnetic field within said container, such that the ferromagnetic articles positioned within said container are magnetically coupled to said magnet, said magnet being substantially complementary to said first plate;

a first hole positioned in said ladder, said first hole being substantially centrally positioned in said upper end of said ladder;

a second hole positioned in said magnet, said second hole being alignable with said first hole, said second hole being substantially centrally positioned in said magnet;

a third hole positioned through said first plate, said third hole being complementary to and alignable with said second hole, said third hole being substantially centrally positioned in said first plate;

a bolt substantially complementary to said second hole and said third hole, wherein said first hole, said second hole and said third hole are positioned for inserting a threaded end of said bolt sequentially through said third hole, said second hole and said first hole, such that a head of said bolt abuts said first plate;

a nut complementary to said bolt, wherein said nut is positioned for threadedly coupling to said bolt to couple said container and said magnet to said ladder;

a washer positioned between said first plate and said head of said bolt;

a second plate, said second plate being substantially rectangularly shaped;

a fourth hole positioned through said second plate, said fourth hole being complementary to said bolt, wherein said fourth hole is positioned in said second plate such that said second plate is positionable between said nut and said ladder, such that said second plate abuts a lower surface of said upper end of said ladder; and wherein said container is positioned on said ladder such that said container is configured for retaining items positioned in said container, wherein said magnet is positioned on said ladder such that said magnet is configured for generating the magnetic field within said container for retaining the ferromagnetic articles within said container as said ladder is reoriented from the substantially vertical configuration to the substantially horizontal configuration.

* * * * *